US008314818B2

(12) United States Patent
Kang

(10) Patent No.: US 8,314,818 B2
(45) Date of Patent: Nov. 20, 2012

(54) LIGHT EMITTING DEVICE AND DRIVING METHOD THEREOF

(75) Inventor: Mun-Seok Kang, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 508 days.

(21) Appl. No.: 12/628,922

(22) Filed: Dec. 1, 2009

(65) Prior Publication Data

US 2010/0315441 A1 Dec. 16, 2010

(30) Foreign Application Priority Data

Jun. 10, 2009 (KR) ..... 10-2009-0051659

(51) Int. Cl.
*G09G 5/10* (2006.01)

(52) U.S. Cl. ..... 345/690

(58) Field of Classification Search ..... 345/690, 345/102, 89, 739
See application file for complete search history.

(56) References Cited

U.S. PATENT DOCUMENTS

| | | | | |
|---|---|---|---|---|
| 4,379,632 | A * | 4/1983 | Dedden et al. | 355/68 |
| 7,609,244 | B2 * | 10/2009 | Kim et al. | 345/89 |
| 8,115,728 | B2 | 2/2012 | Feng | |
| 2006/0284894 | A1 | 12/2006 | Johnson et al. | |
| 2007/0126757 | A1 | 6/2007 | Itoh et al. | |
| 2007/0268240 | A1 | 11/2007 | Lee et al. | |
| 2008/0297464 | A1 | 12/2008 | Ito | |
| 2009/0033610 | A1 | 2/2009 | Cho et al. | |
| 2009/0122207 | A1 | 5/2009 | Inoue et al. | |

FOREIGN PATENT DOCUMENTS

| | | | |
|---|---|---|---|
| JP | 2005-266758 | | 9/2005 |
| JP | 2006-251796 | A | 9/2006 |
| JP | 2006-259619 | | 9/2006 |
| JP | 2006-343706 | | 12/2006 |
| JP | 2007-503610 | A | 2/2007 |
| JP | 2007-310369 | A | 11/2007 |
| JP | 2008-299145 | A | 12/2008 |
| JP | 2009-37195 | A | 2/2009 |
| KR | 10-2006-0089375 | A | 8/2006 |
| KR | 10-2007-0007647 | A | 1/2007 |

(Continued)

OTHER PUBLICATIONS

English Machine Translation of JP 2006-25961, 25 pgs.

(Continued)

*Primary Examiner* — Fred Tzeng
(74) *Attorney, Agent, or Firm* — Christie, Parker & Hale, LLP

(57) ABSTRACT

A light emitting device and a driving method thereof, and a method for reducing motion blur and flicker phenomena of a display is provided. A light emitting device for providing light to a display that displays images is provided. The device includes: a display unit that includes scan lines, column lines, and light emission pixels, the scan lines respectively applied with first scan signals and second scan signals during one frame period; a local brightness controller that generates a dimming signal having brightness information of the light emission pixels, generates motion flag signals having motion information corresponding to the light emission pixels, and generates ratio control signals having division information of the dimming signal according to the motion flag signals; and a controller that divides the dimming signal into first divided dimming data and second divided dimming data according to the ratio control signals.

20 Claims, 8 Drawing Sheets

FOREIGN PATENT DOCUMENTS

| | | | |
|---|---|---|---|
| KR | 10-2007-0080020 | A | 8/2007 |
| KR | 10-2007-0099723 | A | 10/2007 |
| KR | 10-2008-0026718 | A | 3/2008 |
| KR | 10-2008-0062322 | A | 7/2008 |
| WO | WO 2006/100988 | A1 | 9/2006 |
| WO | WO 2008/010561 | A1 | 1/2008 |

OTHER PUBLICATIONS

Japanese Office action dated Jan. 24, 2012 issued in Japanese Patent No. 2009-183454, 3 pgs.

* cited by examiner

| | | | | | | | | | | | | | | | | | |
|---|---|---|---|---|---|---|---|---|---|---|---|---|---|---|---|---|---|
| MF | 0 | 0 | 0 | 0 | 0 | 0 | 0 | 0 | 0 | 0 | 0 | 0 | 0 | 0 | 0 | 0 | ··· |
| DS | 200 | 30 | 240 | 205 | 255 | 190 | 184 | 47 | 55 | 67 | 255 | 255 | 255 | 44 | 170 | 53 | ··· |
| RC | 50 | 50 | 50 | 50 | 50 | 50 | 50 | 50 | 50 | 50 | 50 | 50 | 50 | 50 | 50 | 50 | ··· |
| DSS1 | 100 | 15 | 120 | 103 | 103 | 95 | 92 | 24 | 28 | 34 | 128 | 128 | 128 | 22 | 85 | 27 | ··· |
| DSS2 | 100 | 15 | 120 | 102 | 102 | 95 | 92 | 23 | 27 | 33 | 127 | 127 | 127 | 22 | 85 | 26 | ··· |

(a)

| | | | | | | | | | | | | | | | | | |
|---|---|---|---|---|---|---|---|---|---|---|---|---|---|---|---|---|---|
| MF | 1 | 1 | 0 | 0 | 0 | 0 | 0 | 0 | 0 | 1 | 1 | 1 | 0 | 0 | 1 | 1 | ··· |
| DS | 200 | 30 | 240 | 205 | 255 | 190 | 184 | 47 | 55 | 67 | 255 | 255 | 255 | 44 | 170 | 53 | ··· |
| RC | 60 | 60 | 50 | 50 | 50 | 50 | 50 | 50 | 50 | 60 | 60 | 60 | 50 | 50 | 60 | 60 | ··· |
| DSS3 | 120 | 18 | 120 | 103 | 128 | 95 | 92 | 24 | 28 | 40 | 153 | 153 | 128 | 22 | 102 | 32 | ··· |
| DSS4 | 80 | 12 | 120 | 102 | 127 | 95 | 92 | 23 | 27 | 27 | 102 | 102 | 127 | 22 | 68 | 21 | ··· |

(b)

| | | | | | | | | | | | | | | | | | |
|---|---|---|---|---|---|---|---|---|---|---|---|---|---|---|---|---|---|
| MF | 0 | 1 | 1 | 1 | 1 | 0 | 0 | 1 | 1 | 1 | 0 | 0 | 1 | 1 | 1 | 1 | ··· |
| DS | 100 | 10 | 40 | 44 | 5 | 30 | 255 | 200 | 200 | 74 | 125 | 144 | 47 | 200 | 255 | 255 | ··· |
| RC | 50 | 70 | 60 | 60 | 60 | 50 | 50 | 60 | 60 | 70 | 50 | 50 | 60 | 60 | 70 | 70 | ··· |
| DSS5 | 50 | 7 | 24 | 26 | 3 | 15 | 128 | 120 | 120 | 52 | 63 | 72 | 28 | 120 | 179 | 179 | ··· |
| DSS6 | 50 | 3 | 16 | 18 | 2 | 15 | 127 | 80 | 80 | 22 | 62 | 72 | 19 | 80 | 76 | 76 | ··· |

(c)

LIGHT EMITTING DEVICE AND DRIVING METHOD THEREOF

CROSS-REFERENCE TO RELATED APPLICATIONS

This application claims priority to and the benefit of Korean Patent Application No. 10-2009-0051659, filed in the Korean Intellectual Property Office on Jun. 10, 2009, the entire contents of which are incorporated herein by reference.

BACKGROUND

1. Field

The described technology relates generally to a light emitting device. More particularly, it relates to a light emitting device that emits light in response to electrons emitted due to an electric field, and a driving method thereof.

2. Description of the Related Art

A liquid crystal display (LCD), which is a kind of flat panel display, is a display device that forms images by changing a light transmission amount on a pixel basis using dielectric anisotropy of liquid crystal having a changing twist angle according to an applied voltage. Compared with a cathode ray tube, which is a conventional image display device, the LCD has a merit of decreased weight, thickness, and power consumption. The LCD includes a liquid crystal panel assembly and a light emitting device that is positioned at the rear side of the liquid crystal panel assembly to provide light to the liquid crystal panel assembly.

When the liquid crystal panel assembly is formed as an active liquid crystal panel assembly, the liquid crystal panel assembly includes a pair of transparent substrates, a liquid crystal layer positioned between the transparent substrates, a polarizing plate disposed at an outer surface of the transparent substrates, a common electrode located at an inside surface of one transparent substrate, pixel electrodes and switches that are provided at an inside surface of the other transparent substrate, and a color filter that provides red, green, and blue colors to three sub-pixels constituting a pixel. The liquid crystal panel assembly receives light that is emitted from a light emitting device, and forms images by transmitting or blocking the light with action of the liquid crystal layer.

Since a reaction time of liquid crystal is longer than one frame period, a motion blur phenomenon may occur in the LCD when an image having fast motion for each frame is realized so that a dim after-image is displayed on a screen. In order to solve the motion blur phenomenon, an impulsive method is used so that light sources of the light emitting device are turned on when an image is displayed for one frame and the light sources are turned off the rest of the time. In this way, an after-image of a previous frame is eliminated so that the motion blur phenomenon can be reduced. However, the impulsive method has a problem of causing a flicker phenomenon so that when a still image is displayed on the screen, the image flickers.

The above information disclosed in this Background section is only for enhancement of understanding of the background of the described technology and therefore it may contain information that does not form the prior art that is already known in this country to a person of ordinary skill in the art.

SUMMARY

The described technology provides a light emitting device that can reduce a motion blur phenomenon and a flicker phenomenon, and a driving method thereof.

According to an exemplary embodiment of the present invention, a light emitting device for providing light to a display configured to display an image according to an input video signal and an input video control signal is provided. The light emitting device includes a display unit, a local brightness controller, and a controller. The display unit includes a plurality of scan lines, a plurality of column lines, and a plurality of light emission pixels. Each light emission pixel is for providing light to at least one pixel of the display. The plurality of scan lines is for transmitting first scan signals and second scan signals during one frame period. The local brightness controller is for generating a dimming signal having brightness information of each of the plurality of light emission pixels by reading the input video signal and the input video control signal, generating a plurality of motion flag signals having motion information of each region of the display corresponding to the plurality of light emission pixels, and generating a plurality of ratio control signals having division ratio information of the dimming signal according to the plurality of motion flag signals. The controller is for dividing the dimming signal into a plurality of first divided dimming data corresponding to the first scan signals and a plurality of second divided dimming data corresponding to the second scan signals according to the plurality of ratio control signals.

The local brightness controller may be configured to adjust the plurality of ratio control signals according to the plurality of motion flag signals.

The local brightness controller may be configured to generate a synchronization signal for dividing a frame by using the input video control signal, and to generate a light emission control signal for controlling light emission of each of the plurality of light emission pixels.

The controller may include a data processor, a plurality of memories, and a frame buffer unit. The data processor is for dividing the dimming signal into the plurality of first divided dimming data and the plurality of second divided dimming data according to the plurality of ratio control signals. Each of the plurality of memories includes first and second sub-memories in which the plurality of first divided dimming data and the plurality of second divided dimming data are respectively stored by one frame unit. The frame buffer unit is configured to selectively read or write the plurality of first divided dimming data and the plurality of second divided dimming data from the plurality of memories according to first and second counting signals generated by counting the synchronization signal.

The frame buffer unit may be synchronized with the synchronization signal and configured to generate the first counting signal by counting the synchronization signal, and is synchronized to a time that is delayed by a half of the frame period of the synchronization signal and configured to generate the second counting signal by counting the synchronization signal. The first and second counting signals include digital data having bits indicating a number of the plurality of memories and are iteratively changed by a unit of the number of the plurality of memories.

The frame buffer unit may be configured to write the plurality of first divided dimming data and the plurality of second divided dimming data in an order of the plurality of memories according to the first counting signal.

The frame buffer unit may be configured to read the plurality of first divided dimming data from a first memory that has finished writing of the plurality of first divided dimming data and the plurality of second divided dimming data among the plurality of memories according to the first counting signal, and to read the plurality of second divided dimming data from the first memory according to the second counting signal.

The frame buffer, unit may be configured to alternately read the plurality of first divided dimming data and the plurality of second divided dimming data.

The controller may further include a control signal generator configured to generate a scan driving control signal and a column driving control signal by using the light emission control signal.

The light emitting device may further include a scan driver configured to apply the first scan signals and the second scan signals to the plurality of scan lines according to the scan driving control signal.

The one frame period may be divided into at least two fields including first and second fields, and the scan driver is configured to sequentially apply the plurality of first scan signals corresponding to the first field to the plurality of scan lines and to sequentially apply the plurality of second scan signals corresponding to the second field to the plurality of scan lines.

During the first field, the scan driver may be configured to alternately apply the plurality of first scan signals of a current frame and the plurality of second scan signals of a previous frame.

During the second field, the scan driver may be configured to alternately apply the plurality of second scan signals and the plurality of first scan signals of a current frame.

The light emitting device may further include a column driver for applying a light emission data voltage to the plurality of column lines during a period corresponding to the plurality of first divided dimming data and the plurality of second divided dimming data according to the column driving control signal.

According to another exemplary embodiment of the present invention, a driving method of a light emitting device is provided. The light emitting device includes a plurality of light emission pixels, a plurality of scan lines, and a plurality of column lines. Each light emission pixel is for providing light to at least one pixel of a display. The display is configured to display an image according to an input video signal and an input video control signal. The driving method includes: applying first scan signals and second scan signals to each of the plurality of scan lines during one frame period; generating a dimming signal having brightness information of each of the plurality of light emission pixels by reading the input video signal and the input video control signal; generating a plurality of motion flag signals having motion information of each region of the display corresponding to the plurality of light emission pixels; generating a plurality of ratio control signals having division information of the dimming signal according to the plurality of motion flag signals; and dividing the dimming signal into a plurality of first divided dimming data corresponding to the first scan signals and a plurality of second divided dimming data corresponding to the second scan signals according to the plurality of ratio control signals.

The dividing of the dimming signal into the plurality of first divided dimming data and the plurality of second divided dimming data may include adjusting the plurality of ratio control signals according to the plurality of motion flag signals.

The input video control signal may include a vertical synchronization signal. The driving method may further include: generating a synchronization signal that is synchronized with the vertical synchronization signal; generating a first counting signal in synchronization with the synchronization signal and counting the synchronization signal, and generating a second counting signal in synchronization with a time that is delayed by a half of the frame period of the synchronization signal and counting the synchronization signal; and selectively reading and writing the plurality of first divided dimming data and the plurality of second divided dimming data according to the first and second counting signals.

The selective reading and writing of the plurality of first divided dimming data and the plurality of second divided dimming data may include: writing the plurality of first divided dimming data and the plurality of second divided dimming data of one frame unit according to the first counting signal; when the writing of the plurality of first divided dimming data and the plurality of second divided dimming data of one frame unit is finished, reading the plurality of first divided dimming data according to the first counting signal; and reading the plurality of second divided dimming data according to the second counting signal.

The driving method may further include alternately reading the plurality of first divided dimming data and the plurality of second divided dimming data.

The one frame period may be divided into at least two fields including first and second fields, corresponding to the plurality of first scan signals and the plurality of second scan signals. The driving method may further include: supplying a light emission data voltage to each of a plurality of light emission pixels for a period corresponding to the plurality of first divided dimming data according to an order of the plurality of first scan signals during the first field; supplying the light emission data voltage to each of the plurality of light emission pixels for a period corresponding to the plurality of second divided dimming data according to an order of the plurality of second scan signals during the second field; during the first field, alternately applying the plurality of second scan signals of a previous frame and the plurality of first scan signals of a current frame; and during the second field, alternately applying the plurality of first scan signals and the plurality of second scan signals of the current frame.

As described, according to embodiments of the present invention, motion blur and flicker phenomena of the display can be reduced.

DETAILED DESCRIPTION

Figure 1:
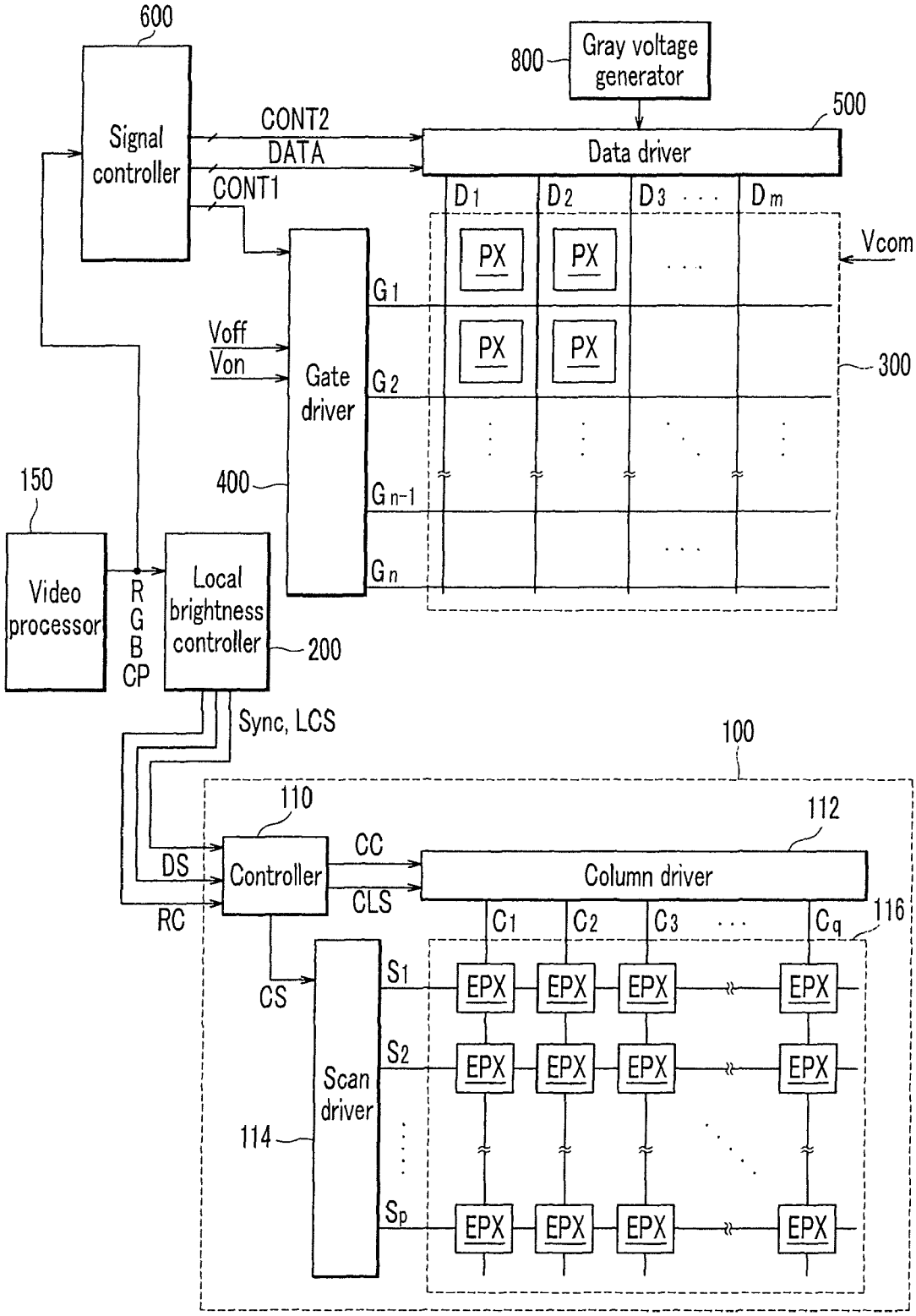
FIG. 1 is a block diagram of a liquid crystal display (LCD) according to an exemplary embodiment.

In the following detailed description, certain exemplary embodiments have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 2:
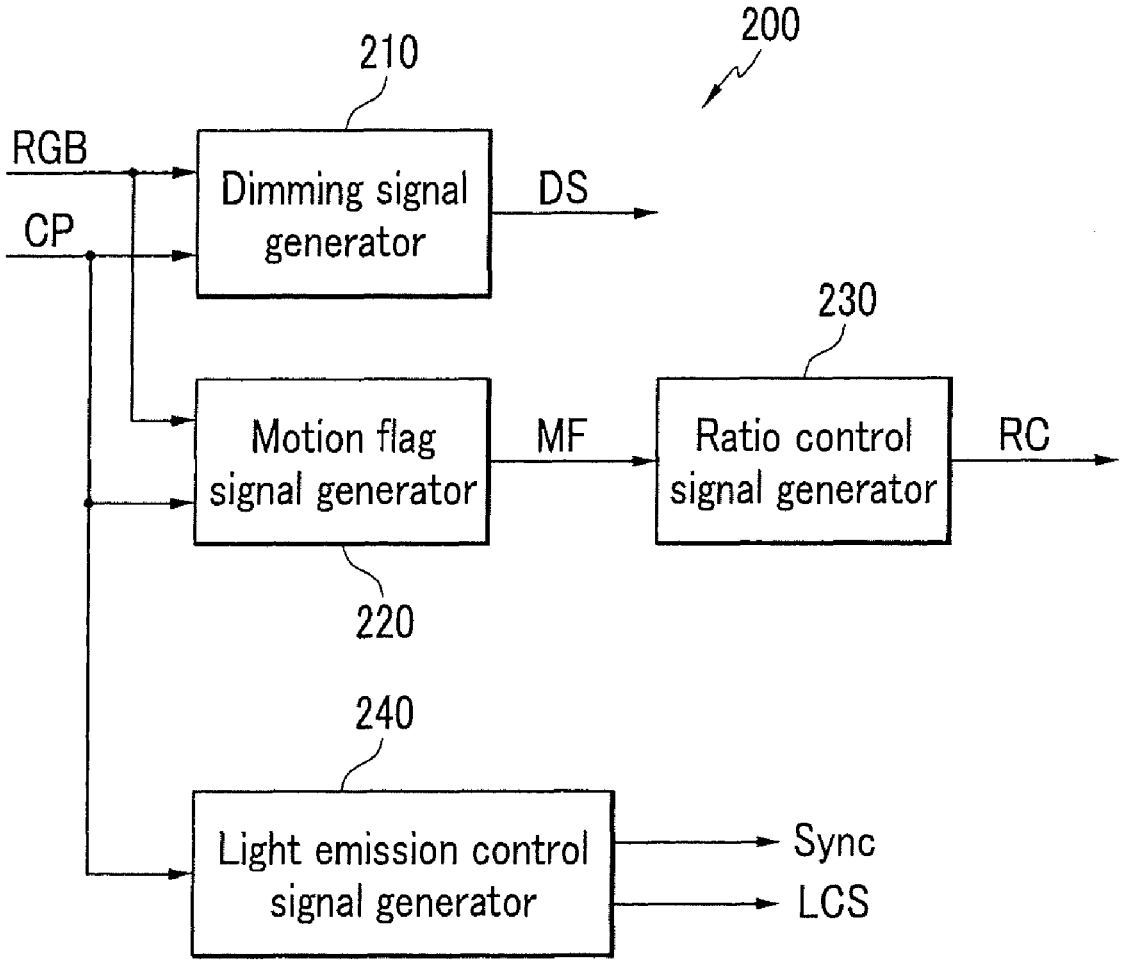
FIG. 2 is a detailed block diagram of a local brightness controller of FIG. 1.
Figure 3:
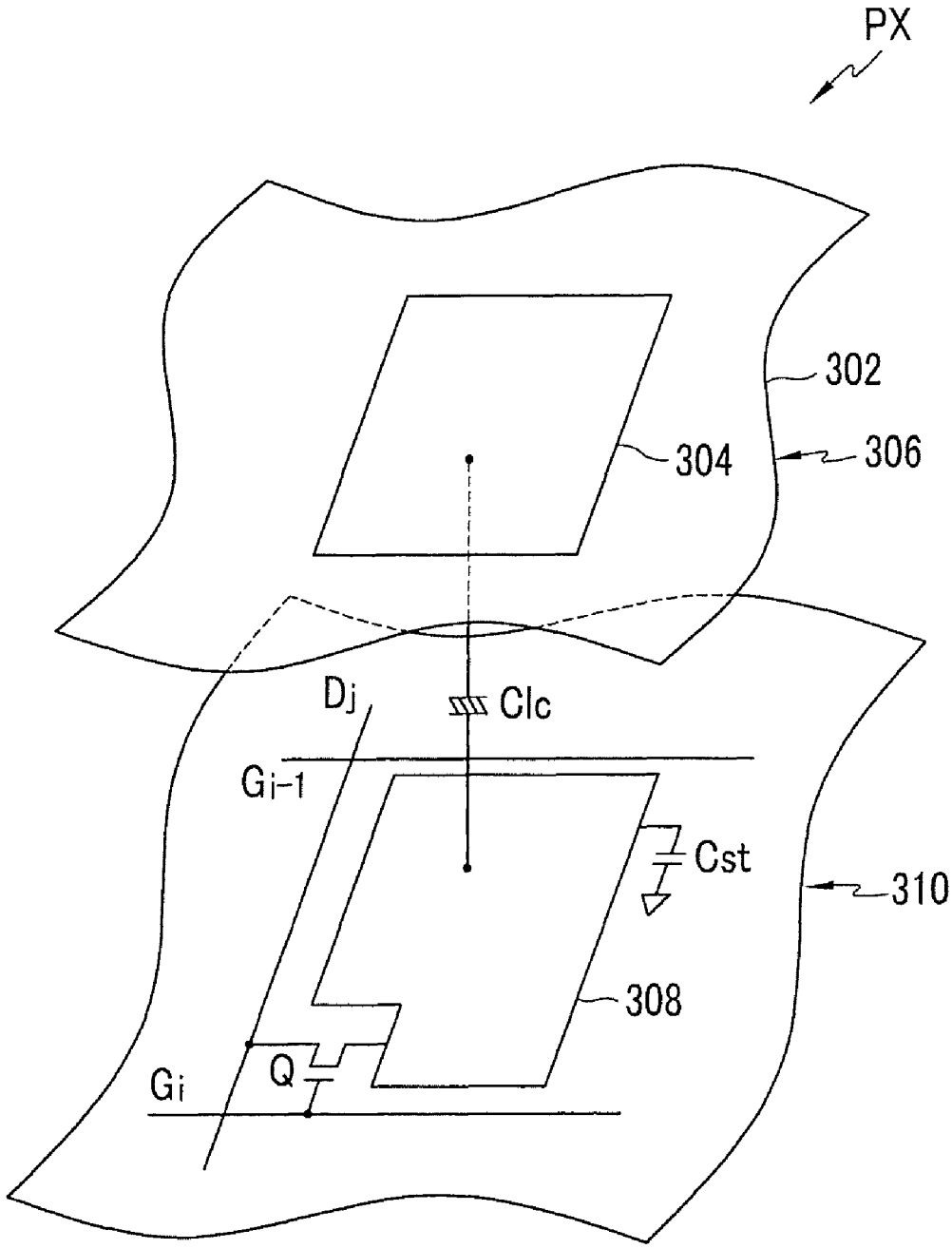
FIG. 3 is an equivalent circuit diagram of a pixel of FIG. 1.
Figure 4:
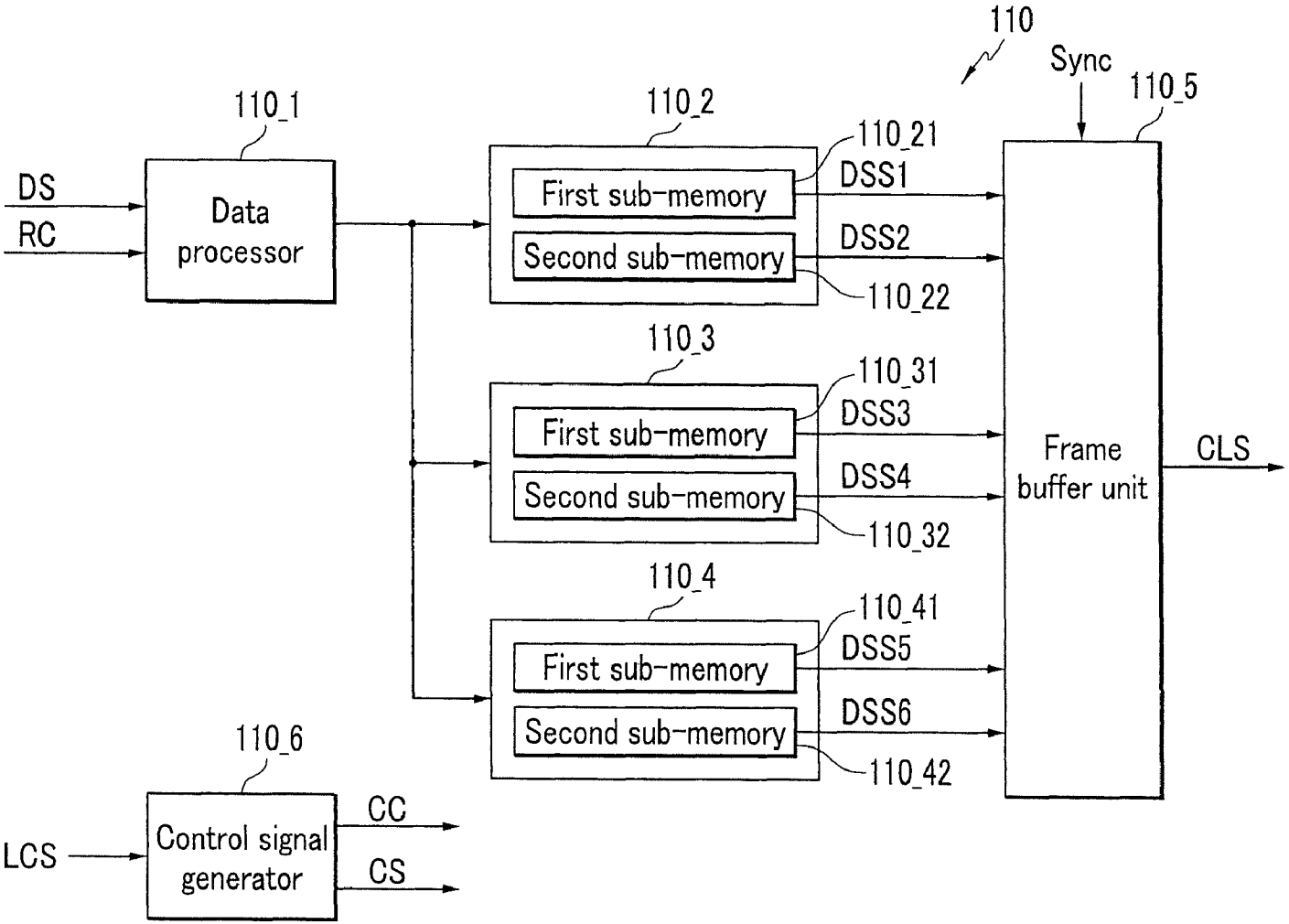
FIG. 4 is a detailed block diagram of a controller of FIG. 1.

FIG. 1 is a block diagram of a liquid crystal display (LCD) according to an exemplary embodiment, and FIG. 2 is a detailed block diagram of a local brightness controller 200 of FIG. 1. FIG. 3 is an equivalent circuit diagram of a pixel PX of FIG. 1, and FIG. 4 is a detailed block diagram of a controller 110 of FIG. 1.

Referring to FIG. 1, an LCD according to an exemplary embodiment includes a light emitting device 100, a video processor 150, a local brightness controller 200, a liquid crystal panel assembly 300, a gate driver 400, a data driver 500, a gray voltage generator 800, and a signal controller 600.

The video processor 150 receives an image signal transmitted from various media, and converts the received image signal to input video signals R, G, and B that correspond to resolution of the LCD, and an input video control signal CP for image display according to the input video signals. The input video signals R, G, and B and the input video control signal CP are input to the local brightness controller 200 and the signal controller 600. The input video signals R, G, and B include luminance information of each pixel PX, and luminance is expressed by a number of grays, for example, grays of $1024=2^{10}$, $256=2^{8}$, or $64=2^{6}$. The input video control signal CP includes control signals Hsync, Vsync, MCLK, and DE for displaying the input video signals R, G, and B.

Referring to FIG. 2, the local brightness controller 200 includes a dimming signal generator 210, a motion flag signal generator 220, a ratio control signal generator 230, and a light emission control signal generator 240. The dimming signal generator 210 reads the input video signals R, G, and B and the input video control signal CP to determine a degree of brightness of each of a plurality of light emission pixels EPX (i.e., light emitting pixels) of the light emitting device 100. The dimming signal generator 210 generates a dimming signal DS where a plurality of dimming data are arranged. Here, the plurality of dimming data respectively represent a degree of brightness of each of the light emission pixels EPX.

In further detail, the dimming signal generator 210 reads the input video signals R, G, and B and the input video control signal CP to detect the highest gray (i.e., gray level) from among a plurality of pixels PX that correspond to one light emission pixel EPX, and determines a gray of the light emission pixel EPX according to the detected gray. In addition, the dimming signal generator 210 generates the dimming signal DS that represents the determined gray. In an exemplary embodiment, the dimming signal DS is realized by 8 bits, but the present invention is not limited thereto.

The motion flag signal generator 220 reads the input video signals R, G, and B and the input video control signal CP to extract motion information for each of a plurality of areas of the liquid crystal panel assembly 300, respectively corresponding to the plurality of light emission pixels EPX, so as to generate a plurality of motion flag signals MF. In further detail, the motion flag signal generator 220 detects a degree of luminance variation of input video signals R, G, and B that respectively correspond to the plurality of areas of the liquid crystal panel assembly 300, respectively corresponding to the plurality of light emission pixels EPX. It is determined that when the luminance variation is significant, the corresponding area has motion, and when the luminance variation is insignificant, the corresponding area does not have motion. In an exemplary embodiment, a high-level motion flag signal MF is generated corresponding to the areas having motion and a low-level motion flag signal MF is generated corresponding to the areas having no motion. However, the embodiment is not limited thereto, and motion flag signals MF may have different levels depending on the motion.

The ratio control signal generator 230 generates a plurality of ratio control signals RC according to respective motion flag signals MF of the plurality of light emission pixels EPX. The ratio control signal RC represents a ratio for dividing dimming data of each light emission pixel EPX into first and second divided dimming data.

The light emitting, device 100 according to an exemplary embodiment transmits a plurality of scan signals to each of a plurality of scan lines S1 to Sp two times for representing one frame. One frame includes a first field including a period for a first transmission of the plurality of scan signals to each of the plurality of scan lines S1 to Sp and a second field including a period for a second transmission of the plurality of scan signals to each of the plurality of scan lines S1 to Sp. The light emitting device 100 controls each of the plurality of light emission pixels EPX to emit light according to a plurality of first divided dimming data and a plurality of second divided dimming data during each field.

The dimming data according to an exemplary embodiment is divided by one frame unit, and indicates a light emission time of the plurality of light emission pixels EPX that form the light emitting device 100 during one frame. In addition, the plurality of first divided dimming data and the plurality of second divided dimming data indicate a light emission time of the plurality of light emission pixels EPX during each field. Luminance expressed by light emission of the plurality of light emission pixels EPX during each of the first and second fields according to the plurality of first divided dimming data and the plurality of second divided dimming data is the same as luminance expressed by light emission of the plurality of light emission pixels EPX during one frame according to the plurality of dimming data that has not been divided into first and second division data. Therefore, the light emitting device 100 controls a degree of light emission of the plurality of light emission pixels EPX by controlling the light emission time according to the plurality of first divided dimming data and the plurality of second divided dimming data during each period of the first and second fields.

In further detail, the ratio control signal RC is a quantization of a ratio applied for division of the dimming data into the first and second divided dimming data, and equals a ratio of the first divided dimming data with respect to the dimming data. For control of a division ratio, the number of bits of the dimming signal DS may be increased or decreased. In an exemplary embodiment, a pulse width of a plurality of light emission data voltages is determined according to the plurality of first divided dimming data and the plurality of second divided dimming data such that a degree of brightness of each of the plurality of light emission pixels EPX is determined.

For example, when the ratio control signal RC is set to 50% and the motion flag signal MF is high level, the ratio control signal RC is increased by units of 10%. When the motion flag signal MF is low level, the ratio control signal RC is decreased by units of 10%. Thus, when the high-level motion flag signal MF is sequentially generated two times, the ratio control signal RC becomes 70%. If a current ratio control signal RC is 70% and the motion flag signal MF is low level, the ratio control signal RC becomes 60% after being decreased by a unit of 10%. However, the ratio control signal RC is not decreased below 50% in one embodiment. In this embodiment, the ratio control signal RC is maintained with at least 50%. As described, the ratio control signal RC varies within 50% to 100% according to the motion flag signal MF.

The light emission control signal generator 240 generates a control signal for driving the light emitting device by using an input video control signal CP. The light emission control signal generator 240 generates a synchronization signal Sync and a light emission control signal LCS for dividing a frame according to the input video control signal CP. The synchronization signal Sync is a control signal for generating a light emission signal CLS that determines a light emission period, and the light emission control signal LCS is a control signal for operation of the light emitting device 100 according to an adaptive scan method. In order to realize the adaptive scan method in one embodiment, frequency modulation of the input video control signal CP is used. In further detail, the light emission control signal LCS includes signals modulated to twice the frequency of a vertical synchronization signal Vsync and a horizontal synchronization signal Hsync. The adaptive scan method will be described in further detail later.

Referring back to FIG. 1, the liquid crystal panel assembly 300 includes a plurality of signal lines $G_1$ to $G_n$ and $D_1$ to $D_m$ and a plurality of pixels PX approximately arranged in a matrix format in an equivalent circuit view. The signal lines $G_1$ to $G_n$ and $D_1$ to $D_m$ include a plurality of gate lines $G_1$ to $G_n$ for transmission of a gate signal (which may also be referred to as a scan signal) and a plurality of data lines $D_1$ to $D_m$. The gate lines $G_1$ to $G_n$ are approximately extended in a row direction and almost parallel with each other, and the data lines $D_1$ to $D_m$ are approximately extended in a column direction and almost parallel with each other.

Referring to FIG. 3, each pixel PX, for example a pixel $PX_{ij}$ connected to the i-th (i=1, 2, n) gate line $G_i$ and the j-th (j=1, 2, m) data line $D_j$, includes a switch Q connected to the signal lines $G_i$ and $D_j$, a liquid crystal capacitor Clc connected to the switch Q, and a storage capacitor Cst. The storage capacitor Cst may be omitted as necessary.

The switch Q is a three-terminal element such as a thin film transistor located in a lower display panel 310. A control terminal of the switch Q is connected to the gate line $G_i$, an input terminal of the switch Q is connected to the data line $D_j$, and an output terminal of the switch Q is connected to the liquid crystal capacitor Clc and the storage capacitor Cst.

The liquid crystal capacitor Clc uses a pixel electrode 308 of the lower display panel 310 and a common electrode 302 of an upper display panel 306 as two terminals, and includes a liquid crystal layer (not shown) between the two electrodes 302 and 308. The pixel electrode 308 is connected to the switch Q, and the common electrode 302 is formed at a front surface of the upper display panel 306 and receives a common voltage Vcom. Unlike the embodiment depicted in FIG. 3, the common electrode 302 may instead be provided on the lower display panel 310, and in this case, at least one of the two electrodes 302 and 308 may be formed in a linear shape or a bar shape.

The sustain capacitor Cst that supports the liquid crystal capacitor Clc is formed by overlapping a separate signal line (not shown) and the pixel electrode 308 that are provided in the lower display panel 310 with an insulator therebetween, and a voltage (e.g., a predetermined voltage) such as a common voltage Vcom is applied to the separate signal line. However, the storage capacitor Cst may be formed by overlapping the pixel electrode 308 with a front-end gate line $G_{i-1}$ on the pixel electrode 308 with an insulator between them.

In order to realize color display, by allowing each pixel PX to inherently display one of primary colors (spatial division) or allowing each pixel PX to sequentially and alternately display primary colors (temporal division), a desired color can be produced with a spatial or temporal combination of the primary colors. The primary colors may include, for example, three primary colors of light, such as red, green, and blue colors. FIG. 3 illustrates an example of a spatial division and shows that each pixel PX has a color filter 304 representing one of the primary colors in an area of the upper display panel 306 corresponding to the pixel electrode 308. Unlike the embodiment depicted in FIG. 3, the color filter 304 may instead be disposed above or below the pixel electrode 308 of the lower display panel 310. At least one polarizer (not shown) is provided in the liquid crystal panel assembly 300.

Referring back to FIG. 1, the gray voltage generator 800 generates all gray voltages or gray voltages of a limited number (hereinafter, referred to as "reference gray voltages") that are related to transmittance of the pixel PX. The reference gray voltages may have a positive value and a negative value relative to a common voltage Vcom.

The gate driver 400 is connected to gate lines $G_1$ to $G_n$ of the liquid crystal panel assembly 300 to apply a gate signal including a combination of a gate-on voltage Von and a gate-off voltage Voff to the gate lines $G_1$ to G.

The data driver 500 is connected to data lines $D_1$ to $D_m$ of the liquid crystal panel assembly 300, selects a gray voltage from the gray voltage generator 800, and applies the gray voltage as a data voltage to the data lines $D_1$ to $D_m$. However, when the gray voltage generator 800 provides reference gray voltages of a limited number instead of providing all gray voltages, the data driver 500 generates a desired data voltage by using the reference gray voltages. The process is known to those skilled in the art, and is not limited to any particular process or method.

The signal controller 600 controls the gate driver 400 and the data driver 500. The signal controller 600 appropriately processes the input video signals R, G, and B to correspond to an operation condition of the liquid crystal panel assembly 300 based on the input video signals R, G, and B and the input video control signal CP that are received from the video processor 150, thereby generating a digital video signal DATA, a gate control signal CONT1, and a data control signal CONT2. The signal controller 600 transmits the generated gate control signal CONT1 to the gate driver 400, and transmits the data control signal CONT2 and the processed digital video signal DATA to the data driver 500.

The gate control signal CONT1 includes a scanning start signal STV that instructs the scanning start and at least one clock signal that controls an output period of a gate-on voltage Von. The gate control signal CONT1 may further include an output enable signal OE that limits a duration time of a gate-on voltage Von.

The data control signal CONT2 includes a horizontal synchronization start signal STH that notifies the start of transmitting a digital video signal DATA for pixels PX of a row to the data driver 500, and a load signal LOAD that instructs to apply an analog data voltage to the data lines $D_1$ to $D_m$. The data control signal CONT2 may further include a reversal signal RVS that inverts the polarity of a data voltage (hereinafter, "polarity of a data voltage to a common voltage" is abbreviated to "polarity of a data voltage") to a common voltage Vcom.

The data driver 500 generates an analog data voltage for each data line by selecting a gray voltage corresponding to the digital video signal DATA and applies the analog data voltages to the corresponding data lines $D_1$ to $D_m$.

The gate driver 400 selectively applies a gate-on voltage Von to each of the gate lines $G_1$ to $G_n$ according to the gate control signal CONT1 from the signal controller 600, thereby turning on a switch Q in each pixel corresponding to a selected gate line from among the gate lines $G_1$ to $G_n$. Accordingly, a data voltage that is applied to one of the data lines $D_1$ to $D_m$ is applied to the corresponding pixel PX through the turned on switch Q.

The difference between the data voltage and the common voltage Vcom that are applied to the pixel PX is represented as a charge voltage, i.e., a pixel voltage of the liquid crystal capacitor Clc. Liquid crystal molecules have different arrangements according to the magnitude of the pixel voltage, and thus polarized light of light that passes through the liquid crystal layer changes. The change of the polarized light is represented with a transmittance change of light by a polarizer, and thus the pixel PX displays luminance that is represented by a gray of a digital video signal DATA.

By repeating such a process using one horizontal period (may be called "1H", and is the same as a period of a horizontal synchronization signal Hsync and a data enable signal DE) in units, a gate-on voltage Von is, for example, sequentially applied to all gate lines $G_1$ to $G_n$ and a data voltage is applied to all pixels PX, thereby displaying an image of a frame.

The light emitting device 100 includes a controller 110, a column driver 112, a scan driver 114, and a display unit 116. As shown in FIG. 4, the controller 110 includes a data processor 110_1, a plurality of first to third memories 110_2 to 110_4, a frame buffer unit 110_5, and a control signal generator 110_6.

The data processor 110_1 divides a plurality of dimming data of one frame unit according to the corresponding ratio control signal RC to generate a plurality of first divided dimming data and a plurality of second divided dimming data. The data processor 110_1 transmits the plurality of first divided dimming data DSS1, DSS3, and DSS5 and the plurality of the second divided dimming data DSS2, DSS4, and DSS6 to a corresponding memory from among the plurality of first to third memories 110_2 to 110_4. That is, the first memory 110_2 stores a plurality of first divided dimming data DSS1 and a plurality of second divided dimming data DSS2 of the n-th frame, and the second memory 110_3 stores a plurality of first divided dimming data DSS3 and a plurality of second divided dimming data DSS4 of the (n+1)-th frame. The third memory 110_4 stores a plurality of first divided dimming data DSS5 and a plurality of second divided dimming data DSS6 of the (n+2)-th frame. A plurality of first divided dimming data and a plurality of second divided dimming data of the next frame are stored in this way.

In an exemplary embodiment, the three memories (i.e., the first to third memories 110_2 to 110_4) are the minimum number of memories required for adaptive scanning. The adaptive scanning method according to an exemplary embodiment transmits the plurality of scan signals to each of the plurality of scan lines $S_1$ to $S_p$ two times for representing one frame, and when the scan signals are respectively transmitted two times, a light emission period of each light emission pixel EPX is determined by the ratio control signal RC.

In further detail, when the ratio control signal RC is 50%, a light emission period of a light emission pixel EPX during the first scan signal application period is the same as that of a light emission pixel EPX during the second scan signal application period. If the ratio control signal RC is 60%, a ratio of a light emission period of a light emission pixel EPX during the first scan signal application period and a light emission period of a light emission pixel EPX during the second scan signal application period is 6:4.

As described, the light emission period of the light emission pixel EPX for each of the two scan signal applications is determined according to motion of an image formed on the plurality of liquid crystal pixels PX that correspond to the light emission pixel EPX. For the adaptive scanning method, one frame includes a first field and a second field, and temporal overlap occurs between a second field of a previous frame and a first field of a current frame and between the first field and a second field of the current frame. Therefore, scan signals between frames and between first and second fields of each frame may be concurrent. This will be described later with reference to FIG. 7. Accordingly, the embodiment may include three or more memories.

The first memory 110_2 is formed of two sub-memories 110_21 and 110_22. The plurality of first divided dimming data DSS1 are stored in the first sub-memory 110_21, and the plurality of second divided dimming data DSS2 are stored in the second sub-memory 110_22. The second memory 110_3 is formed of first and second sub-memories 110_31 and 110_32, and the plurality of first divided dimming data DSS3 and the plurality of second divided dimming data DSS4 are respectively stored in the first and second sub-memories 110_31 and 110_32. The third memory 110_4 is formed of first and second sub-memories 110_41 and 110_42, and the plurality of first divided dimming data DSS5 and the plurality of second divided dimming data DSS6 are respectively stored in the first and second sub-memories 110_41 and 110_42. Here, the number of sub-memories included in the respective first to third memories 110_2 to 110_4 may be controlled according to the number of divisions of the plurality of dimming data.

The frame buffer unit 110_5 reads the plurality of first divided dimming data DSS1, DSS3, and DSS5 and the plurality of second divided dimming data DSS2, DSS4, and DSS6 respectively stored in the first to third memories 110_2 to 110_4, and sequentially outputs the read data as light emission signals CLS. The frame buffer unit 110_5 includes two counters (not shown). The frame buffer unit 110_5 writes the plurality of first divided dimming data DSS1, DSS3, and DSS5 and the plurality of second divided dimming data DSS2, DSS4, and DSS6 respectively to the first to third memories 110_2 to 110_4 according to a counter pulse output from one of the two counters, and reads the plurality of first divided dimming data DSS1, DSS3, and DSS5 from the respective first sub-memories 110_21, 110_31, and 110_41 of the first to third written memories 110_2 to 110_4. In addition, according to a counter pulse of the other counter, the frame buffer unit 110_5 reads the plurality of second divided dimming data DSS2, DSS4, and DSS6 from the respective second sub-memories 110_22, 110_32, and 110_42 of the first to third memories 110_2 to 110_4. This will be described in further detail later with reference to FIG. 5.

The control signal generator 110_6 generates a scan driving control signal CS and a column driving control signal CC by using the light emission control signal LCS, and transmits the generated signals respectively to the scan driver 114 and the column driver 112. The scan driving control signal CS includes a scan start signal STV1 that instructs scan start for the respective plurality of scan lines $S_1$ to $S_p$ and at least one clock signal that controls an output period of a scan on voltage VN. The scan driving control signal CS according to an exemplary embodiment has a frequency that is two times that of a gate control signal CONT1. A scan signal supplied to the plurality of scan lines $S_1$ to $S_p$ according to the scan driving control signal CS will be described later with reference to FIG. 7. A column driving control signal CC includes a horizontal synchronization start signal STH1 that informs the column driver 112 of transmission start of the light emission signal CLS to each light emission pixel EPX of one row, and a load signal LOAD that applies a light emission data voltage to the column lines to $C_1$ to $C_q$ according to the light emission signal CLS.

The column driver 112 is connected to the plurality of column lines $C_1$ to $C_q$, and controls a light emission pixel EPX to emit light corresponding to a gray of a plurality of liquid crystal pixels PX (that correspond to the light emission pixel EPX) according to the column driving control signal CC and the light emitting signal CLS. In further detail, the column driver 112 determines a pulse width of a plurality of light emission data voltages according to the light emitting signal CLS, and transmits the light emission data voltages to the plurality of column lines $C_1$ to $C_q$ according to the column driving control signal CC. That is, the column driver 112 synchronizes the light emission pixel EPX to emit light with a gray (e.g., a predetermined gray) for an image displayed on a plurality liquid crystal pixels PX corresponding to one light emission pixel EPX.

The scan driver 114 is connected to the plurality of scan lines $S_1$ to $S_p$, and transmits a plurality of scan signals to the plurality of scan lines $S_1$ to $S_p$ for light emission of the light emission pixel EPX (in synchronization with a plurality of corresponding liquid crystal pixels PX) according to the scan driving control signal CS.

The display unit 116 includes the plurality of scan lines $S_1$ to $S_p$ that transmit scan signals, the plurality of column lines $C_1$ to $C_q$ that transmit light emission data signals, and the plurality of light emission pixels EPX. Each of the plurality of light emission pixels EPX is located in an area defined by the scan lines $S_1$ to $S_p$ and the column lines $C_1$ to $C_q$ crossing the scan lines. Each of the plurality of light emission pixels EPX according to an exemplary embodiment is formed of a field emission array (FEA) type of electron emission element. The FEA type electron emission element includes a scan electrode, a data electrode, an electron emission region electrically connected to one of the scan and data electrodes, and a phosphor layer. The electron emission region may be made of a material having a low work function or a material having a high aspect ratio, e.g., a carbon-based material or a nanometer-sized material. The FEA type electron emission element forms an electric field around the electron emission region by using a voltage difference between the scan electrode and the data electrode to emit electrons to excite a phosphor layer to thus emit visible light of a strength corresponding to an emission amount of electron beams.

Figure 5:
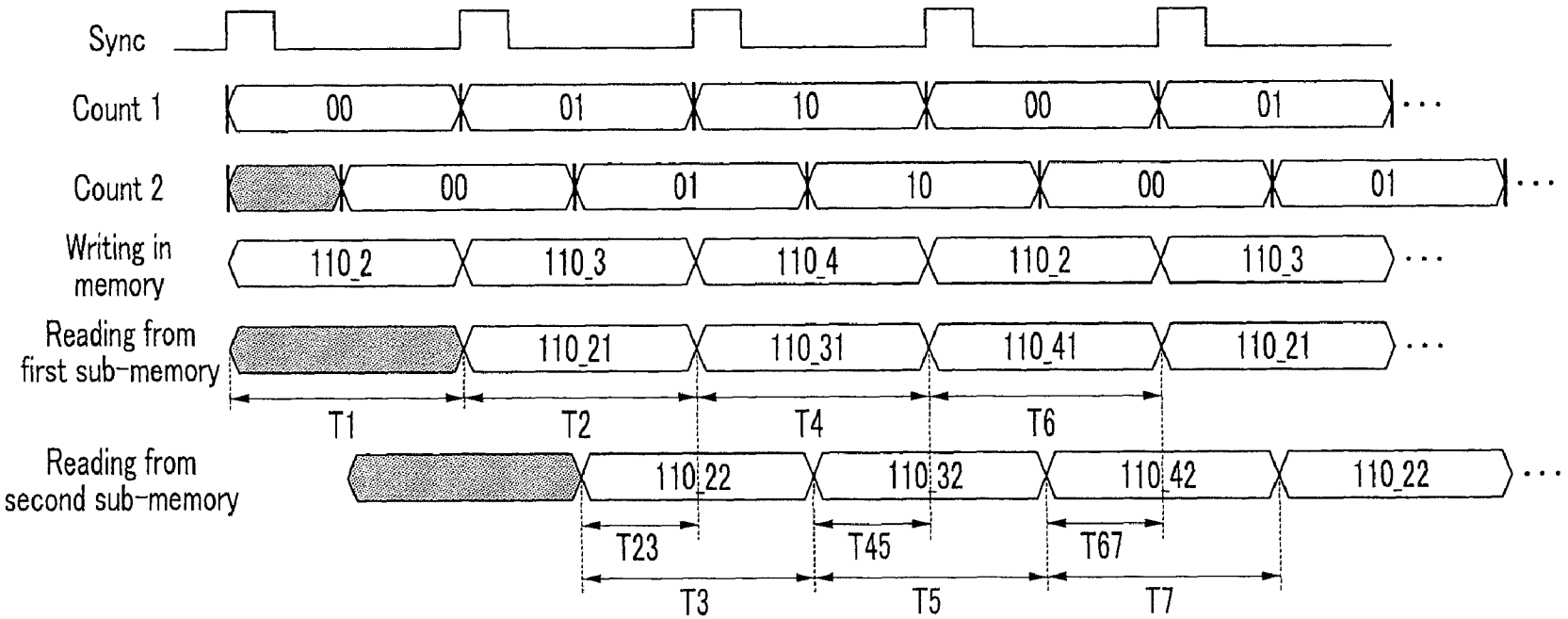
FIG. 5 shows operation of the controller according to an exemplary embodiment.

FIG. 5 shows operation of the controller 110 according to an exemplary embodiment.

Referring to FIG. 5, a first counting signal Count1 and a second counting signal Count2 are generated according to a synchronization signal Sync. Here, the synchronization signal Sync is a signal that is synchronized with a vertical synchronization signal Vsync generated by the video processor 150, and has a frequency that is the same as that of the vertical synchronization signal Vsync. In addition, the synchronization signal Sync includes a pulse having a high-level period (e.g., a predetermined high-level period) at a start point of each period. The first counting signal Count1 is synchronized with a rising edge of the synchronization signal Sync and is iteratively counted in an order of "00, 01, 10", and the second counting signal Count2 is iteratively counted in an order of "00, 01, 10" with a time gap that corresponds to a half period of the synchronization signal Sync with the first counting signal Count1.

The first counting signal Count1 and the second counting signal Count2 according to an exemplary embodiment are realized with digital data having bits that can indicate the number of the plurality of memories 110_2 to 110_4, and is iteratively changed by a unit of the number of plurality of memories 110_2 to 110_4. For a period T1 during which the first counting signal Count1 is "00", the plurality of first divided dimming data DSS1 are written in the first sub-memory 110_21 of the first memory 110_2 and the plurality of second divided dimming data DSS2 are written in the second sub-memory 110_22. For a period T2 during which the first counting signal Count1 is "01", the plurality of first divided dimming data DSS3 are written in the first sub-memory 110_31 of the second memory 110_3 and the plurality of second divided dimming data DSS4 are written in the second sub-memory 110_32. In addition, the frame buffer unit 110_5 reads the first divided dimming data DSS1 from the first sub-memory 110_21 during the period T2.

Next, starting halfway through period T2, for a period T3 during which the second counting signal Count2 is "01," the frame buffer unit 110_5 reads the plurality of second divided dimming data DSS2 from the second sub-memory 110_22. Then, starting at the completion of period T2, for a period T4 during which the first counting signal Count1 is "10", the plurality of first divided dimming data DSS5 are written in the first sub-memory 110_41 of the third memory 110_4 and the plurality of second divided dimming data DSS6 are written in the second sub-memory 110_42. In addition, the frame buffer unit 110_5 reads the plurality of first divided dimming data DSS3 from the first sub-memory 110_31 during the period T4.

Next, starting halfway through period T4, for a period T5 during which the second counting signal Count2 is "10," the frame buffer unit 110_5 reads the plurality of second divided dimming data DSS4 from the second sub-memory 110_32. Then, starting at the completion of period T4, for a period T6 during which the first counting signal Count1 is "00", the plurality of first divided dimming data DSS1 are written in the first sub-memory 110_21 of the first memory 110_2 and the plurality of second divided dimming data DSS2 are written in the second sub-memory 110_22. In addition, the frame buffer unit 110_5 reads the plurality of first divided dimming data DSS5 from the first sub-memory 110_41.

Finally, starting halfway through period T6, for a period T7 during which the second counting signal Count2 is "00," the frame buffer unit 110_5 reads the plurality of second divided dimming data DSS6 from the second sub-memory 110_42. In this way, the plurality of first divided dimming data DSS1, DSS3, and DSS5 and the plurality of second divided dimming data DSS2, DSS4, and DSS6 that respectively correspond to each frame are output as the light emission signals CLS.

The frame buffer unit 110_5 generates the light emission signal CLS by alternately arranging the plurality of first divided dimming data DSS1, DSS3, and DSS5 and the plurality of second divided dimming data DSS2, DSS4, and DSS6 read from the respective sub-memories. That is, for a period T23 during which the period T2 and the period T3 overlap, the frame buffer unit 110_5 alternately arranges the plurality of first divided dimming data DSS1 read from the first sub-memory 110_21 and the plurality of second divided dimming data DSS2 read from the second sub-memory 110_22. For a period T45 during which the period T4 and the period T5 overlap, the frame buffer unit 110_5 alternately arranges the plurality of first divided dimming data DSS3 read from the first sub-memory 110_31 and the plurality of second divided dimming data DSS4 read from the second sub-memory 110_32.

In addition, for a period T67 during which the period T6 and the period T7 overlap, the frame buffer unit 110_5 alternately arranges the plurality of first divided dimming data DSS5 read from the first sub-memory 110_41 and the plurality of second divided dimming data DSS6 read from the second sub-memory 110_42. As described, the frame buffer unit 110_5 alternately arranges the first divided dimming data and the second divided dimming data because the plurality of scan signals are transmitted two times to the plurality of scan lines $S_1$ to $S_p$ according to the adaptive scanning method of the embodiment.

Figure 6:
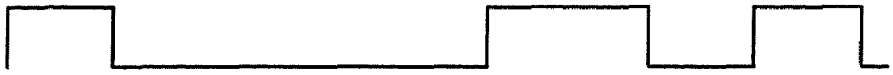
FIG. 6 shows a motion flag signal, a dimming signal, a ratio control signal, first divided dimming data, and second divided dimming data.
Figure 6:
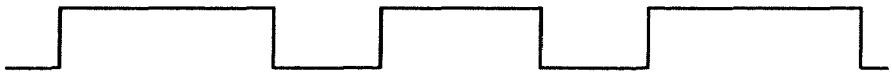

FIG. 6 shows the motion flag signal MF, the dimming signal DS, the ratio control signal RC, the plurality of first divided dimming data DSS1, DSS3, and DSS5, and the plurality of second divided dimming data DSS2, DSS4, and DSS6 according to an exemplary embodiment.

FIG. 6 is provided to describe how the plurality of dimming data of the dimming signal DS are divided into the plurality of first divided dimming data and the plurality of second divided dimming data through signal division and a ratio operation according to the motion flag signal MF. In FIG. 6, the motion flag signal MF, the dimming signal DS, the ratio control signal RC, the plurality of first divided dimming data DSS1, DSS3, and DSS5, and the plurality of second divided dimming data DSS2, DSS4, and DSS6 are represented by a decimal scale.

Referring to FIG. 6, the ratio control signal RC is generated at 50% in a region where the motion flag signal MF is low level ("0") in the n-th frame (a) so that ratios of the plurality of first divided dimming data DSS1 and the plurality of second divided dimming data DSS2 respectively become 50%. For example, when dimming data in the corresponding region is 200, the plurality of first divided dimming data DSS1 become 100 and the plurality of second divided dimming data DSS2 become 100.

When a motion flag signal MF of the corresponding region in the (n+1)-th frame (b) is high level ("1"), the ratio control signal RC is generated at 60% so that the ratio of the plurality of first divided dimming data DSS3 is increased to 60% and the ratio of the plurality of second divided dimming data DSS4 is decreased to 40%. Then, for example, when dimming data in the corresponding region is 200, the plurality of first divided dimming data DSS3 become 120 and the plurality of second divided dimming data DSS4 become 80.

When the motion flag signal MF of the corresponding region in the (n+2)-th frame (c) is low level ("0"), the ratio control signal RC is generated at 50% so that the ratio of the plurality of first divided dimming data DSS5 is decreased to 50% and the ratio of the plurality of second divided dimming data DSS6 is increased to 50%. Then, for example, when dimming data in the corresponding region is 200, the plurality of first divided dimming data DSS5 become 100 and the plurality of second divided dimming data DSS6 become 100. In this case, although the motion flag signal MF is continuously low level ("0"), the ratio control signal RC is not decreased lower than 50%, and when the motion flag signal MF is continuously high level ("1"), the ratio control signal RC is increased to 100%.

Figure 7:
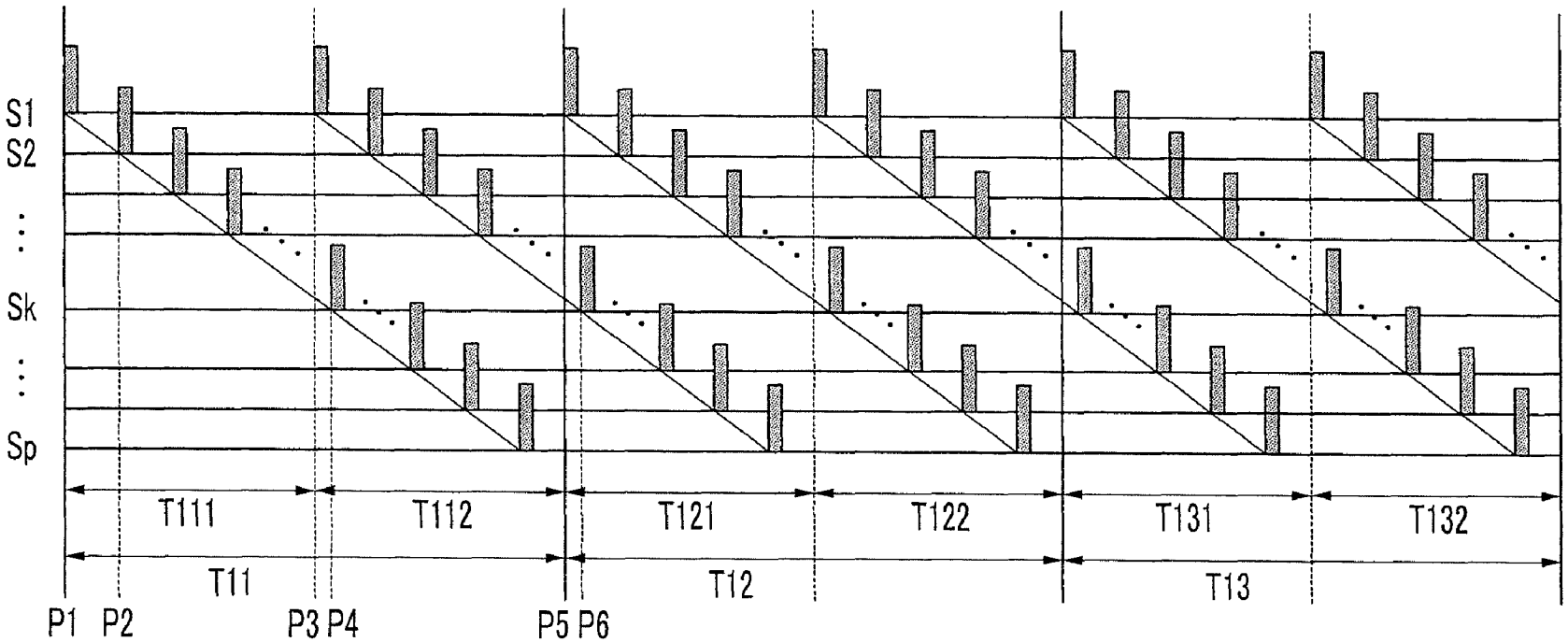
FIG. 7 shows a scan signal applied to a plurality of scan lines according to an exemplary embodiment.

FIG. 7 shows the scan signal supplied to the plurality of scan lines $S_1$ to $S_p$ according to an exemplary embodiment. Corresponding to the first application of the scan signal from among the two applications of the scan signal, a plurality of light emission data voltages are respectively applied to the plurality of column lines $C_1$ to $C_q$ for a period (e.g., a predetermined period) according to a corresponding light emission signal. In this case, the light emitting signal CLS is a plurality of first divided dimming data that correspond to a plurality of light emission pixels connected to the corresponding scan line. In addition, corresponding to the second application of the scan signal, each of the plurality of light emission data voltages is applied to each of the plurality of column lines for a predetermined period. In this case, the light emitting signal is a plurality of second divided dimming data that correspond to a plurality of light emission pixels connected to the corresponding scan line.

In FIG. 7, the horizontal axis is a time axis and the vertical axis corresponds to the plurality of scan lines $S_1$ to $S_p$. In FIG. 7, periods T11, T12, and T13 each represent a unit of 1/60 second. During a period T111, a first field of the n-th frame starts from a time P1. From the time P1, a plurality of light emission data voltages according to a plurality of first divided dimming data DSS1 of the n-th frame is transmitted to the plurality of light emission pixels EPX. For this, the first scan signal is applied to the scan line $S_1$ at the time P1. Next, the first scan signal is applied to the scan line $S_2$ at a time P2. As described, a plurality of first scan signals are sequentially applied to the plurality of scan lines $S_1$ to $S_{k-1}$.

Next, during a period T112, a second field of the n-th frame starts from a time P3. From the time P3 of the period T112, a plurality of light emission data voltages according to a plurality of second divided dimming data DSS2 of the n-th frame is transmitted to the plurality of light emission pixels EPX. For this, the second scan signal is applied to the scan line $S_1$ at the time P3. In addition, during a period T112, a plurality of light emission data voltages according to the rest of the plurality of first divided dimming data DSS1 of the n-th frame is transmitted to the plurality of light emission pixels EPX. For this, the plurality of first scan signals are sequentially applied to the rest of the plurality of scan lines $S_k$ to $S_p$. Since two or more scan signals cannot be simultaneously applied, the first scan signal is applied to the scan line $S_k$ at a time P4 after the second scan signal is applied to the scan line $S_1$ at the time P3. After the second scan signal is applied to the scan line $S_2$, the first scan signal is applied to the scan line $S_{k+1}$. As described, during the period T112, the first and second scan signals of the n-th frame are alternately applied to the plurality of scan $S_1$ to $S_p$.

During a period T121, a first field of the (n+1)-th frame starts from a time P5. For the time P5, a plurality of light emission data voltages according to a plurality of first divided dimming data DSS3 of the (n+1)-th frame is transmitted to the light emission pixels EPX. For this, the first scan signal is applied to the scan line $S_1$ at the time P5. In addition, during the period T121, a plurality of light emission data voltages according to the rest of the plurality of second divided dimming data DSS2 of the n-th frame is transmitted to the plurality of light emission pixels EPX. For this, a plurality of second scan signals are sequentially applied to the rest of the plurality of scan lines $S_k$ to $S_p$. In this case, the second scan signal is applied to the scan line $S_k$ at a time P6 after the first scan signal is applied to the scan line $S_1$ at the time P5. As described, a plurality of first scan signals of the (n+1)-th frame and a plurality of second scan signals of the n-th frame are alternately applied during the period T121.

In a like manner, starting at a period T122, a second field of the (n+1)-th frame starts and a plurality of second scan signals of the (n+1)-th frame are sequentially applied to the plurality of scan lines $S_1$ to $S_p$ during periods T122 and T131. A plurality of light emission data voltages synchronized to a time that the second scan signals are sequentially applied to the plurality of scan lines $S_1$ to $S_p$ and generated according to a light emission signal CLS corresponding to a plurality of second divided dimming data of the (n+1)-th frame are applied to the plurality of column lines $C_1$ to $C_q$.

In addition, starting at a period T131, a first field of the (n+2)-th frame starts and a plurality of first scan signals corresponding to the (n+2)-th frame are sequentially applied to the plurality of scan lines $S_1$ to $S_p$ during the periods T131 and T132. Synchronized to a time that the plurality of first scan signals are sequentially applied to the plurality of scan lines $S_1$ to $S_p$, a plurality of light emission data voltages generated according to a light emission signal CLS corresponding to a plurality of first divided dimming data of the (n+2)-th frame are applied to the plurality of column lines $C_1$ to $C_q$. In a like manner as described above, the scan signals are applied to the plurality of scan lines $S_1$ to $S_p$.

Figure 8:
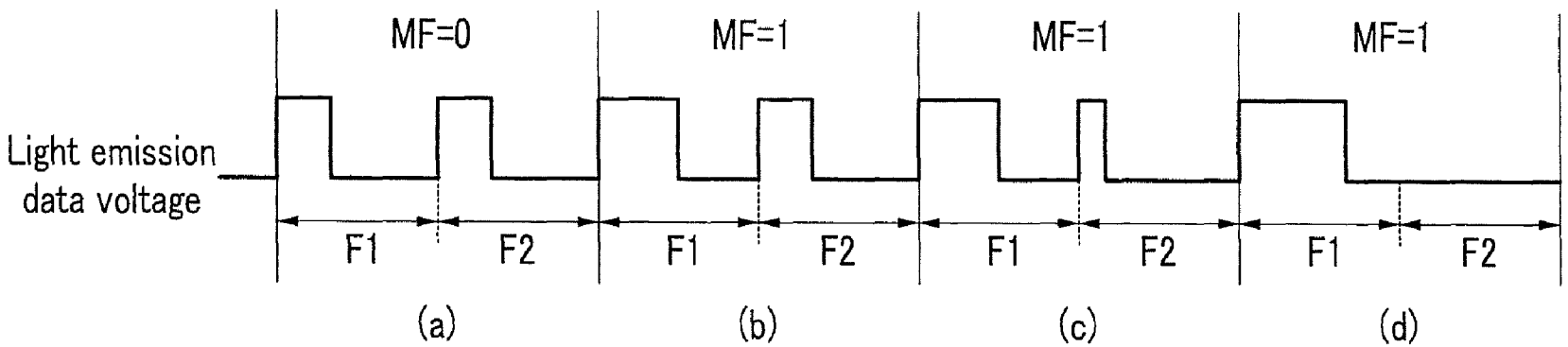
FIG. 8 shows a light emitting data voltage according to an exemplary embodiment.

FIG. 8 shows a light emission data voltage according to an exemplary embodiment, and it shows variation of a light emission data voltage application period to the corresponding light emission pixel corresponding to a specific region of the display unit 116 according to variation of a motion flag signal MF in a frame sequence in the specific region.

Referring to FIG. 8, when the motion flag signal MF is low level ("0") in the n-th frame (a), a pulse width of a light emission data voltage applied to the corresponding light emission pixel EPX during a first field F1 and a pulse width of a light emission data voltage applied to the corresponding light emission pixel EPX during a second field F2 are the same when the first scan signal is applied. When the motion flag signal MF is changed to high level ("1") in the (n+1)-th frame (b), a pulse width of a light emission data voltage applied to the corresponding light emission pixel EPX during a first field F1 is increased by a ratio (e.g., a predetermined ratio, such as 10%) and a pulse width of a light emission data voltage applied during a second field F2 is decreased, for example, by 10%.

Next, when the motion flag signal MF is continuously high level ("1") in the (n+2)-th frame (c), a pulse width of a light emission data voltage applied to the corresponding light emission pixel EPX during a first field F1 is increased, for example, by 20%, and a pulse width of a light emission data voltage applied during a second field F2 is decreased by 20%. When the motion flag signal MF is continuously high level ("1"), a ratio of a pulse width of a light emission data voltage applied to the corresponding light emission pixel EPX during a first field F1 in the (n+3)-th frame (d) becomes, for example, 100%.

Thus, a pulse width ratio of a light emission data voltage applied to the corresponding light emission pixel EPX during first and second fields F1 and F2 is controlled according to the motion flag signal MF. For a region having no motion, light emission data voltage periods are set to be the same during the first and second fields F1 and F2 of one frame to thereby reduce the flicker phenomenon in the region. For a region having a motion, a light emission data voltage period during a first field F1 of one frame is set to be shorter than a light emission data voltage period during a second field to thereby prevent influence of an image of a current frame on the next frame. Accordingly, a motion blur phenomenon can be reduced.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A light emitting device for providing light to a display configured to display an image according to an input video signal and an input video control signal, comprising:

a display unit comprising a plurality of scan lines, a plurality of column lines, and a plurality of light emission pixels, each light emission pixel for providing light to at least one pixel of the display, the plurality of scan lines for transmitting first scan signals and second scan signals during one frame period;

a local brightness controller for generating a dimming signal having brightness information of each of the plurality of light emission pixels by reading the input video signal and the input video control signal, generating a plurality of motion flag signals having motion information of each region of the display corresponding to the plurality of light emission pixels, and generating a plurality of ratio control signals having division ratio information of the dimming signal according to the plurality of motion flag signals; and a controller for dividing the dimming signal into a plurality of first divided dimming data corresponding to the first scan signals and a plurality of second divided dimming data corresponding to the second scan signals according to the plurality of ratio control signals.

2. The light emitting device of claim 1, wherein the local brightness controller is configured to adjust the plurality of ratio control signals according to the plurality of motion flag signals.

3. The light emitting device of claim 1, wherein the local brightness controller is configured to generate a synchronization signal for dividing a frame by using the input video control signal, and to generate a light emission control signal for controlling light emission of each of the plurality of light emission pixels.

4. The light emitting device of claim 3, wherein the controller comprises:

a data processor for dividing the dimming signal into the plurality of first divided dimming data and the plurality of second divided dimming data according to the plurality of ratio control signals;

a plurality of memories each comprising first and second sub-memories in which the plurality of first divided dimming data and the plurality of second divided dimming data are respectively stored by one frame unit; and a frame buffer unit configured to selectively read or write the plurality of first divided dimming data and the plurality of second divided dimming data from the plurality of memories according to first and second counting signals generated by counting the synchronization signal.

5. The light emitting device of claim 4, wherein:

the frame buffer unit is synchronized with the synchronization signal and configured to generate the first counting signal by counting the synchronization signal, and is synchronized to a time that is delayed by a half of the frame period of the synchronization signal and configured to generate the second counting signal by counting the synchronization signal; and the first and second counting signals comprise digital data having bits indicating a number of the plurality of memories and are iteratively changed by a unit of the number of the plurality of memories.

6. The light emitting device of claim 4, wherein the frame buffer unit is configured to write the plurality of first divided dimming data and the plurality of second divided dimming data in an order of the plurality of memories according to the first counting signal.

7. The fight emitting device of claim 4, wherein the frame buffer unit is configured to read the plurality of first divided dimming data from a first memory that has finished writing of the plurality of first divided dimming data and the plurality of second divided dimming data among the plurality of memories according to the first counting signal, and to read the plurality of second divided dimming data from the first memory according to the second counting signal.

8. The fight emitting device of claim 7, wherein the frame buffer unit is configured to alternately read the plurality of first divided dimming data and the plurality of second divided dimming data.

9. The light emitting device of claim 4, wherein the controller further comprises a control signal generator configured to generate a scan driving control signal and a column driving control signal by using the light emission control signal.

10. The fight emitting device of claim 9, further comprising a scan driver configured to apply the first scan signals and the second scan signals to the plurality of scan lines according to the scan driving control signal.

11. The light emitting device of claim 10, wherein the one frame period is divided into at least two fields comprising first and second fields, and the scan driver is configured to sequentially apply the first scan signals corresponding to the first field to the plurality of scan lines and to sequentially apply the second scan signals corresponding to the second field to the plurality of scan lines.

12. The light emitting device of claim 11, wherein, during the first field, the scan driver is configured to alternately apply the first scan signals of a current frame and the second scan signals of a previous frame.

13. The light emitting device of claim 11, wherein, during the second field, the scan driver is configured to alternately apply the second scan signals and the first scan signals of a current frame.

14. The light emitting device of claim 9, further comprising a column driver for applying a light emission data voltage to the plurality of column lines during a period corresponding to the plurality of first divided dimming data and the plurality of second divided dimming data according to the column driving control signal.

15. A driving method of a light emitting device including a plurality of light emission pixels, each light emission pixel for providing light to at least one pixel of a display configured to display an image according to an input video signal and an input video control signal, a plurality of scan lines, and a plurality of column lines, comprising:

applying first scan signals and second scan signals to each of the plurality of scan lines during one frame period;

generating a dimming signal having brightness information of each of the plurality of light emission pixels by reading the input video signal and the input video control signal;

generating a plurality of motion flag signals having motion information of each region of the display corresponding to the plurality of light emission pixels;

generating a plurality of ratio control signals having division information of the dimming signal according to the plurality of motion flag signals; and dividing the dimming signal into a plurality of first divided dimming data corresponding to the first scan signals and a plurality of second divided dimming data corresponding to the second scan signals according to the plurality of ratio control signals.

16. The driving method of claim 15, wherein the dividing of the dimming signal into the plurality of first divided dimming data and the plurality of second divided dimming data comprises adjusting the plurality of ratio control signals according to the plurality of motion flag signals.

17. The driving method of claim 15, wherein the input video control signal comprises a vertical synchronization signal, and the driving method further comprises:

generating a synchronization signal that is synchronized with the vertical synchronization signal;

generating a first counting signal in synchronization with the synchronization signal and counting the synchronization signal, and generating a second counting signal in synchronization with a time that is delayed by a half of the frame period of the synchronization signal and counting the synchronization signal; and selectively reading and writing the plurality of first divided dimming data and the plurality of second divided dimming data according to the first and second counting signals.

18. The driving method of claim 17, wherein the selective reading and writing of the plurality of first divided dimming data and the plurality of second divided dimming data comprises:

writing the plurality of first divided dimming data and the plurality of second divided dimming data of one frame unit according to the first counting signal;

when the writing of the plurality of first divided dimming data and the plurality of second divided dimming data of one frame unit is finished, reading the plurality of first divided dimming data according to the first counting signal; and reading the plurality of second divided dimming data according to the second counting signal.

19. The driving method of claim 18, further comprising alternately reading the plurality of first divided dimming data and the plurality of second divided dimming data.

20. The driving method of claim 15, wherein the one frame period is divided into at least two fields comprising first and second fields, corresponding to the first scan signals and the second scan signals, and the driving method further comprises:

supplying a light emission data voltage to each of the plurality of light emission pixels for a period corresponding to the plurality of first divided dimming data according to an order of the first scan signals during the first field;

supplying the light emission data voltage to each of the plurality of light emission pixels for a period corresponding to the plurality of second divided dimming data according to an order of the second scan signals during the second field;

during the first field, alternately applying the second scan signals of a previous frame and the first scan signals of a current frame; and during the second field, alternately applying the first scan signals and the second scan signals of the current frame.

* * * * *

UNITED STATES PATENT AND TRADEMARK OFFICE

CERTIFICATE OF CORRECTION

PATENT NO. : 8,314,818 B2
APPLICATION NO. : 12/628922
DATED : November 20, 2012
INVENTOR(S) : Kang It is certified that error appears in the above-identified patent and that said Letters Patent is hereby corrected as shown below:

In the Claims

| | |
|---|---|
| Column 17, Claim 7, line 1 | Delete "fight"<br>Insert -- light -- |
| Column 17, Claim 8, line 9 | Delete "fight"<br>Insert -- light -- |
| Column 17, Claim 10, line 17 | Delete "fight"<br>Insert -- light -- |

Signed and Sealed this
Twenty-fourth Day of June, 2014

Michelle K. Lee

Michelle K. Lee
*Deputy Director of the United States Patent and Trademark Office*